US011644023B2

(12) United States Patent
Boccato et al.

(10) Patent No.: US 11,644,023 B2
(45) Date of Patent: May 9, 2023

(54) AIR COMPRESSOR

(71) Applicant: FIAC S.R.L., Sasso Marconi (IT)

(72) Inventors: Lorenzo Boccato, Sasso Marconi (IT); Massimo Marafioti, Zola Predosa (IT)

(73) Assignee: FIAC S.R.L., Sasso Marconi (IT)

( * ) Notice: Subject to any disclaimer, the term of this patent is extended or adjusted under 35 U.S.C. 154(b) by 16 days.

(21) Appl. No.: 17/138,743

(22) Filed: Dec. 30, 2020

(65) Prior Publication Data

US 2021/0199100 A1 Jul. 1, 2021

(30) Foreign Application Priority Data

Dec. 31, 2019 (IT) ..... 202019000004792

(51) Int. Cl.

| | |
|---|---|
| ***F04B 35/04*** | (2006.01) |
| ***F04B 39/12*** | (2006.01) |
| ***F04B 49/02*** | (2006.01) |
| ***F04B 49/10*** | (2006.01) |
| ***H01H 3/08*** | (2006.01) |
| ***H01H 3/20*** | (2006.01) |
| ***H01H 3/02*** | (2006.01) |

(52) U.S. Cl.

CPC ..... *F04B 35/04* (2013.01); *F04B 39/121* (2013.01); *F04B 49/022* (2013.01); *F04B 49/10* (2013.01); *H01H 3/0206* (2013.01); *H01H 3/08* (2013.01); *H01H 3/20* (2013.01)

(58) Field of Classification Search

CPC ..... F04B 49/022; F04B 49/10; H01H 3/08; H01H 3/12; H01H 3/0206; H01H 3/02; H01H 3/20; H01H 9/20; H01H 25/06; H01H 25/065; H01H 2221/01; H01H 19/03; H01H 19/14; H01H 19/003; H01H 19/635

USPC .... 200/43.18, 43.11, 43.13, 43.16, 329, 336, 200/330, 331, 318.1, 564, 568

See application file for complete search history.

(56) References Cited

U.S. PATENT DOCUMENTS 1,047,575 A * 12/1912 Schneider ..... H01H 13/62 200/318.1
1,638,905 A * 8/1927 Aalborg ..... H01H 13/62 200/531
2,363,854 A * 11/1944 Bierenfeld ..... H01H 13/02 200/321
3,170,995 A * 2/1965 Mullen ..... H01H 25/065 200/4
3,348,014 A * 10/1967 Brown ..... H01H 15/10 200/333

(Continued)

*Primary Examiner* — Christopher S Bobish
(74) *Attorney, Agent, or Firm* — Shuttleworth & Ingersoll, PLC; Timothy Klima

(57) ABSTRACT

An air compressor includes a cylinder and a piston reciprocably movable inside the cylinder, an electric motor configured to drive the pump, and a pressure switch, including a push-button for activating and deactivating the pressure switch, movable between first and second operating positions. A housing covers the pump electric motor and pressure switch. A switch, coupled to the housing and movable between first and second operating positions is configured to move the push-button such that when the switch is in the first operating position, the push-button is in the respective first position and, when the switch is in the second operating position, the push-button is free to switch between the first and the second position.

16 Claims, 5 Drawing Sheets

(56) References Cited

U.S. PATENT DOCUMENTS

| | | | | | |
|---|---|---|---|---|---|
| 4,733,035 | A * | 3/1988 | Ohashi | H01H 13/62 | 200/43.18 |
| 5,159,706 | A * | 10/1992 | Hodsdon | H04B 1/38 | 455/90.3 |
| 5,440,089 | A * | 8/1995 | Prokop | H01H 3/20 | 200/321 |
| 5,495,868 | A * | 3/1996 | Cummings | H01H 3/0206 | 137/625.48 |
| 6,031,190 | A * | 2/2000 | Tokuda | B60K 37/06 | 200/11 R |
| 6,610,947 | B2 * | 8/2003 | Campana | H01H 19/03 | 200/336 |
| 6,727,449 | B2 * | 4/2004 | Spiegel | H01H 19/03 | 74/567 |
| 7,202,433 | B2 * | 4/2007 | Howie | H01H 19/03 | 200/336 |
| 7,541,553 | B2 * | 6/2009 | Meyer | H01H 13/72 | 200/310 |
| 7,902,476 | B2 * | 3/2011 | Querejeta Andueza | F24C 3/103 | 200/569 |
| 8,044,310 | B2 * | 10/2011 | Wildman | F04B 49/03 | 200/81 R |
| 8,809,707 | B2 * | 8/2014 | Wildman | F04B 49/022 | 200/81 R |
| 9,396,886 | B2 * | 7/2016 | Reinhart | H01H 9/04 | |
| 9,496,098 | B1 * | 11/2016 | Hammer | G01J 1/44 | |
| 2008/0257695 | A1 * | 10/2008 | Hickman | B29C 73/166 | 200/61.86 |

* cited by examiner

AIR COMPRESSOR

This application claims priority to Italian Patent Application 202019000004792 filed Dec. 31, 2019, the entirety of which is incorporated by reference herein.

This invention relates to an air compressor.

Air compressors are used in many different application sectors, both professionally and domestically.

Indeed, whilst professional use of air compressors has become established, it is also becoming increasingly widespread in a domestic setting, for example with reference to hobbies or even to more common activities such as washing/suction.

By way of example only, the compressor described is of the reciprocating type. Reciprocating compressors compress air by means of a piston which is movable with reciprocating motion inside a cylinder.

The air compressor comprises a pressure switch, that is to say, a device configured to keep the pressure inside the tank within the limits of use. In prior art compressors, the pressure switch is usually separate from the pumping unit body. The peripheral position of the pressure switch may result in one or more disadvantages, for example the pressure switch and its activating push-button are not properly protected, or an end user (above all in the case of a private, non-professional user) may become distracted during use of the compressor while searching for the activating push-button.

The aim of this invention is to provide a positive-displacement air compressor which is easy and practical to use. As well as having a lower number of exposed and damageable parts.

A further aim of this invention is to provide a positive-displacement air compressor which is effective, simple and convenient to use.

The technical features of this invention, in accordance with the above-mentioned aims, are clearly inferable from the content of the present disclosure.

Moreover, the advantages of this invention will become more apparent from the detailed description which follows, with reference to the accompanying drawings which illustrate an example, non-limiting embodiment, in which.

Figure 1:
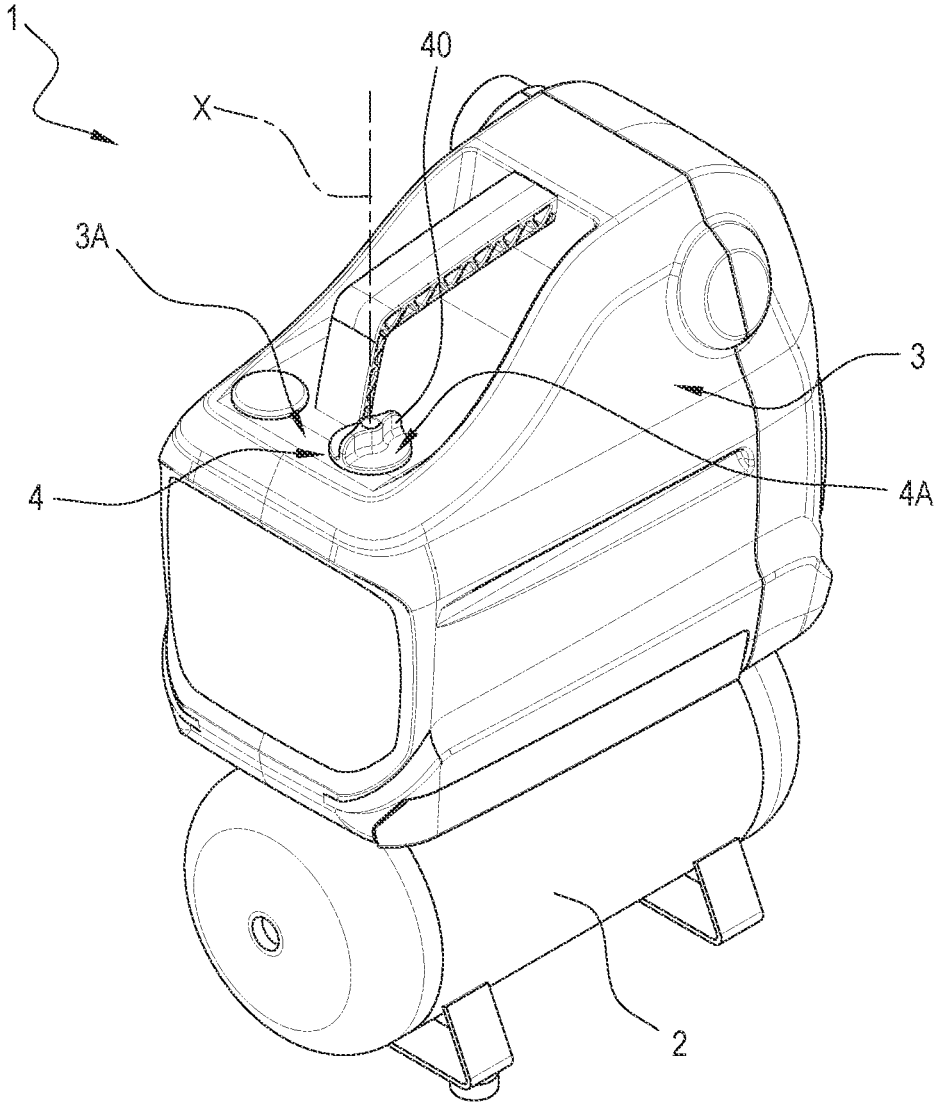
FIG. 1 is a schematic perspective view of an embodiment of an air compressor according to this invention.
Figure 3:
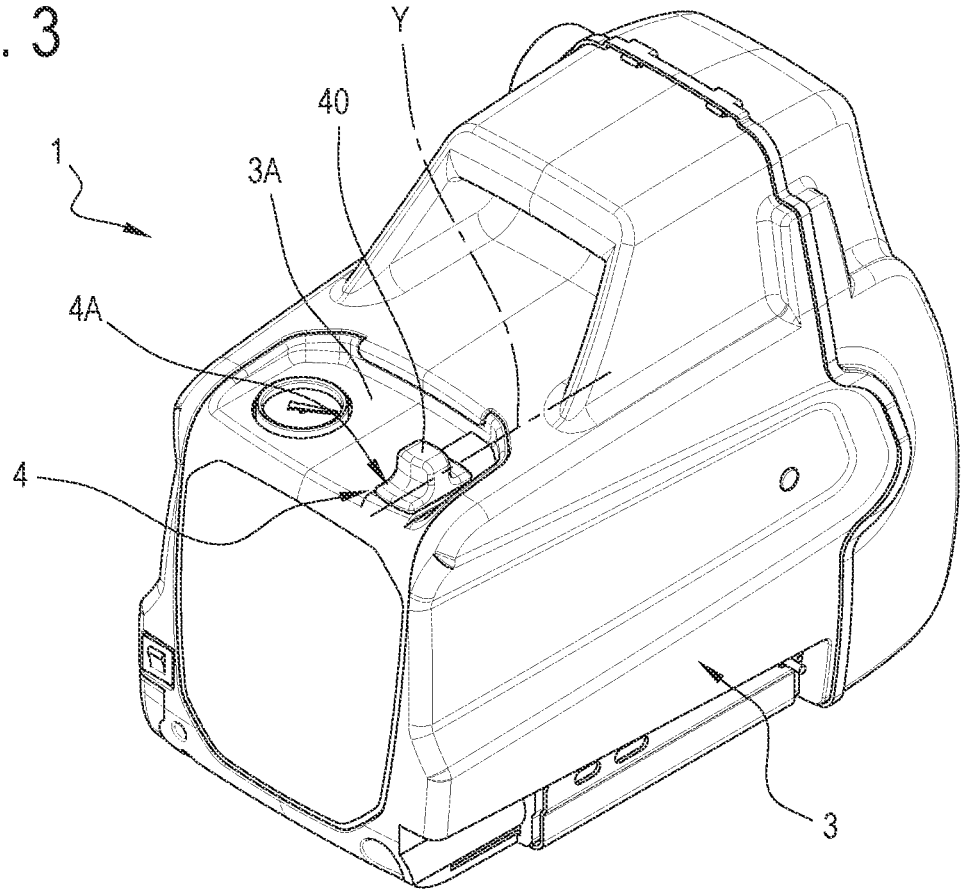
FIG. 3 is a schematic perspective view of an embodiment of an air compressor according to this invention.

In particular with reference to FIGS. 1 and 3, the numeral 1 denotes as a whole an air compressor, for example transportable, according to this invention. The air compressor 1, described and illustrated in more detail limited to the parts necessary for an understanding of this solution, comprises:

- at least one pumping unit, substantially known and not visible in the figures, comprising a cylinder inside which a piston moves with reciprocating motion,

- an electric motor, also not illustrated, configured to drive the at least one pumping unit,
- a pressure switch 5 comprising a body 5*a* and a push-button 50 for activating and deactivating or switching off, movable between a first position and a second position,
- a housing 3, configured to cover at least said at least one pumping unit, said electric motor and said pressure switch, and
- a switch 4, coupled to the housing 3 and movable between a first operating position and a second operating position.

The switch 4 is configured to move the activating and switching off push-button 50, in such a way that, when the switch 4 is in the first operating position, the push-button 50 is in the respective first position and, when the switch 4 is in the second operating position, the push-button 50 is free to switch between the first and the second position.

The push-button 50 may for example switch between the first position and the second position. The first position of the push-button 50 may correspond to a deactivation of the pressure switch 5, for example electric contacts inside the body 5*a* of the pressure switch are opened, that is to say, are not in contact, and the second position of the push-button 50 may correspond to an activation of the pressure switch 5, for example the electric contacts are closed, that is to say, are in contact. For example, the first position of the push-button 50 may correspond to a pressed down position of the self-same push-button 50 and the second position of the push-button 50 may correspond to a raised position of the self-same push-button 50. The first position of the push-button 50 may be an operating configuration and the second position of the push-button 50 may be a home position, and the push-button 50 may comprise inside it an elastic element, for example a spring, which keeps the push-button 50 in the home state in the second position. The movement between the first and the second position may bring the push-button 50 away from the body 5*a* of the pressure switch 5, and vice versa. For example, when the push-button 50 is in the second position, the pressure switch 5 is configured to activate the pumping unit; when the push-button 50 is in the first position, the pressure switch 5 is configured to inhibit the movements of the pumping unit.

When the pressure switch 5 is operating, the push-button 50 may automatically switch between the first position and the second position. For example, automatic switching may occur as a function of reaching a predetermined pressure in a tank 2 fed by the pumping unit.

Alternatively, as described in more detail below, switching from the first position to the second position and/or vice versa may occur as a function of an intervention by a user who moves the push-button 50 by means of the switch 4.

For example, the switch 4 is connected or constrained to the housing 3 and/or preferably switches between the first and the second operating positions. According to one aspect, in addition or alternatively to the housing 3, the switch 4 may be connected or constrained to the pressure switch 5.

The switch 4 is substantially placed at the push-button 50 and is configured to move the push-button 50 for activating and deactivating the pressure switch 5. In this way, when the switch 4 is in the first operating position, the push-button 50 is pressed and brought into the first position; when the switch 4 is in the second operating position, the push-button 50 is free to switch between the first position and the second position. In other words, when the switch 4 is in the first operating position, the push-button 50 is kept in the first position and is prevented from switching between the first position and the second position.

For simplicity, hereinafter reference will be made to the non-limiting example in which the first operating position of the switch 4 corresponds to the first position of the push-button 50 of the pressure switch 5.

In an alternative embodiment it is possible that the second operating position of the switch 4 corresponds to the first position of the push-button 50 which in turn causes inhibition of the pumping unit.

In one or more embodiments, the compressor 1 may be mounted on a tank 2, illustrated for example in FIG. 1. As illustrated in FIG. 1, all of the components of the compressor 1 are in use covered by the housing 3 and therefore are not visible and/or accessible from the outside, unless the housing 3 is removed.

According to one aspect of the invention, the switch 4 may be constrained to the housing 3 at a surface 3A of the housing 3. Thanks to the fact that the push-button 50 of the pressure switch can be pressed by the switch 4 exposed by the housing 3, it is possible to simultaneously protect the pressure switch 5 and its push-button 50, and to operate the pressure switch 5.

The switch 4 preferably comprises a grip element 40 for facilitating movement of the switch 4 by a user. The grip element 40 may be located at an exposed first surface 4A of the switch 4, that is to say, visible on the housing 3. For example, the grip element 40 may be formed on the first surface 4A of the switch 4. The grip element 40 may project outside the housing 3.

The switch 4 also comprises a jutting portion 42, covered by the housing 3 and which projects towards the inside of the self-same housing 3. The jutting portion 42 may be located at a second surface 4B of the switch, opposite to the exposed surface 4A. The jutting portion 42 may be part of the second surface 4B. The jutting portion 42 is configured to move the push-button 50 of the pressure switch 5 as a function of the movement of the switch 4. In this way, a movement of the switch 4 corresponds to a movement of the push-button 50 of the pressure switch 5. As is described in more detail below, the jutting portion 42 has a predetermined shape which allows the movement of the push-button 50 away from or towards the body 5*a* of the pressure switch 5.

According to one aspect, one part of the switch 4 is exposed by the housing 3 (for example, surface 4A and grip element 40) and part of the switch 4 faces and projects towards the inside of the housing 3 (for example the jutting portion 42).

The switch 4, the grip element 40 and the jutting portion 42 may be formed in a single body, or they may be assembled by means of fixing elements, for example screws.

According to one aspect, the housing 3 may comprise one or more end of stroke elements 32, which are configured to guide the movement of the switch 4 and/or to stop the stroke of the switch 4 in a predetermined position, for example in the first operating position and in the second operating position. In addition or alternatively, the housing 3 may comprise one or more locking elements 34, which are configured to engage with the switch 4 at least when the switch 4 is in the first position. For example, the one or more locking elements 34 may be configured to prevent the switch 4 from shifting from the first position, unless this is due to an intervention by an operator.

The end of stroke element 32 may be a rise, for example a step, in the surface 3A of the housing 3 which is located at the switch 4. The end of stroke element 32 is configured to allow the switch 4 to translate between the first and the second operating positions and to prevent a movement of the switch 4 beyond the first and the second positions. In other words, when the switch 4 reach either one or the other position, it is no longer able to continue the stroke any further.

In addition or alternatively, the locking element 34 may consist of a rise, for example a tooth, in the surface 3A of the housing 3 which is located at the switch 4. The rise may be configured to engage with the switch 4 when the switch 4 is in the first operating position. In other words, during the translation of the switch 4 between the second operating position and the first operating position, a part of the switch 4 passes over the locking element 34, so as to remain in position. The locking element 34 and the switch 4 may stably engage with each other when the switch 4 reaches the first position, for example in a snap-on fashion.

Figure 5A:
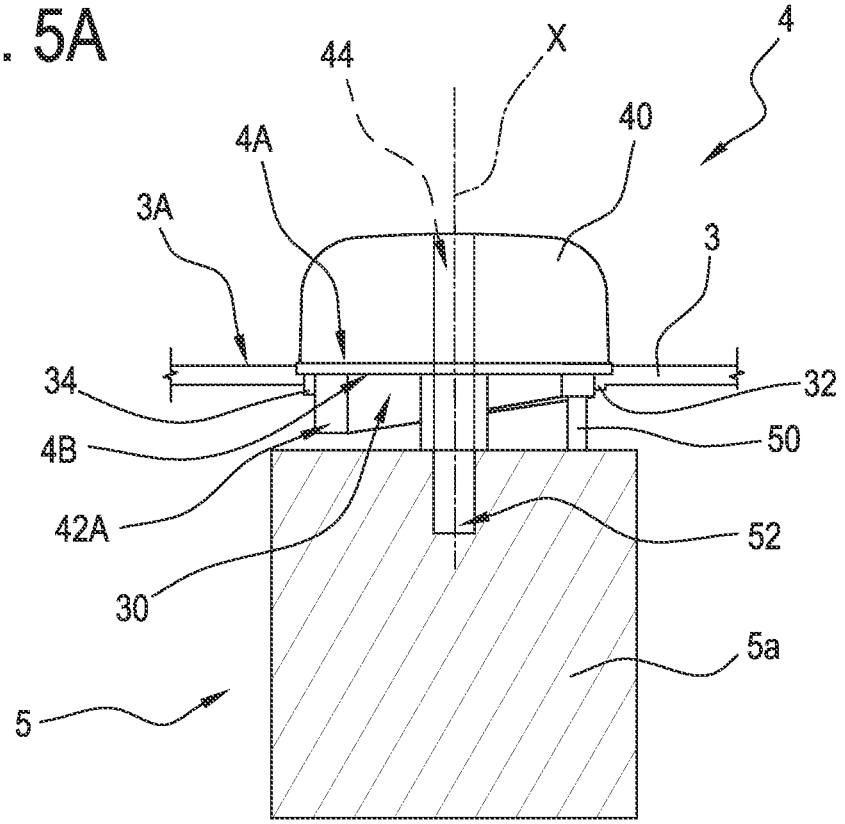
FIGS. 5A and 5B are schematic cross-sections of a detail of one or more embodiments of an air compressor according to this invention.
Figure 5B:
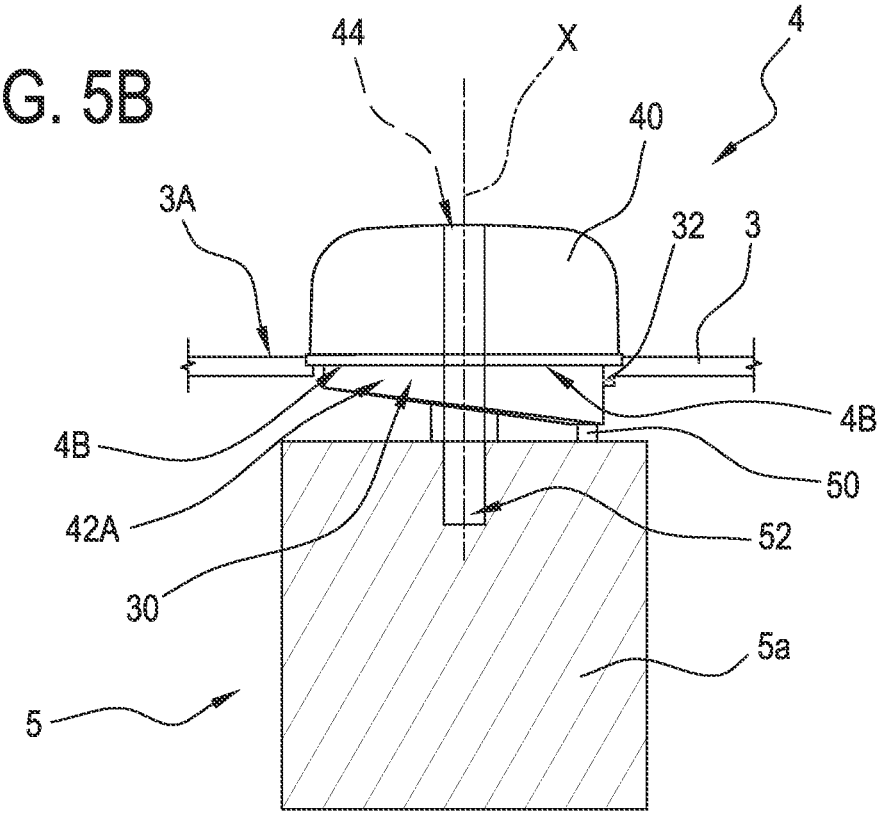
Figure 6A:
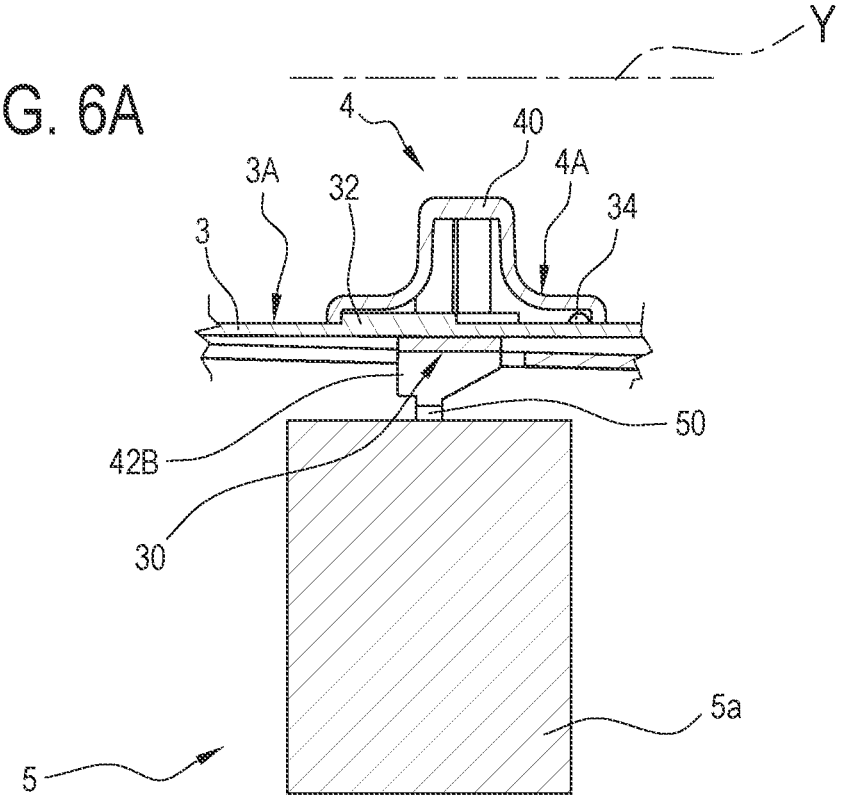
FIGS. 6A and 6B are schematic cross-sections of a detail of one or more embodiments of an air compressor according to this invention.
Figure 6B:
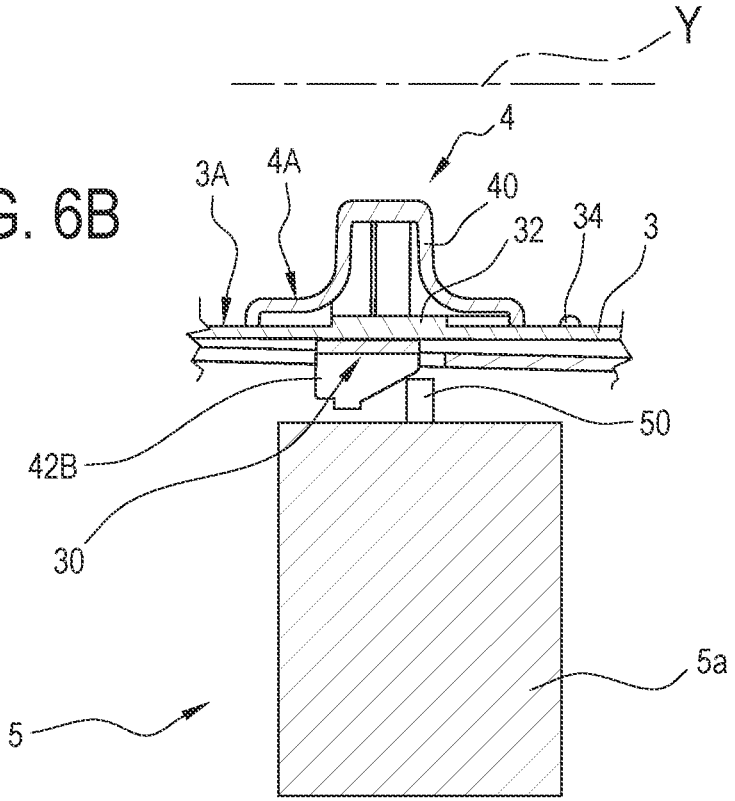

Although illustrated in FIGS. 6A and 6B, the end of stroke element 32 and/or the locking element 34 may be applied to what is illustrated in FIGS. 5A and 5B.

That solution is advantageous, since the elastic element inside the push-button 50 of the pressure switch 5 can apply a force which is not negligible against the jutting portion 42 of the switch 4. Without the presence of one or more locking elements 34, the push-button 50 may be able to push the switch 4 out of the first operating position. Therefore, the locking element 34 may be configured to prevent the switch 4 from autonomously shifting from the first operating position.

According to one aspect of the invention, the end of stroke element 32 and/or the locking element 34 may be rigid and stable. Preferably, the one or more end of stroke elements 32 and/or the one or more locking elements 34 may be located at the first surface 3A of the housing. Even more preferably, the one or more end of stroke elements 32 may be covered by the switch 4. Even more preferably, the one or more locking elements 34 may be covered by the switch 4 when the switch 4 is in the first operating position.

According to one aspect, the housing 3 comprises an opening 30 into which the switch 4 can be inserted. At the opening 30, there may be elements present which facilitate keeping the switch 4 in contact with the housing 3.

Figure 2:
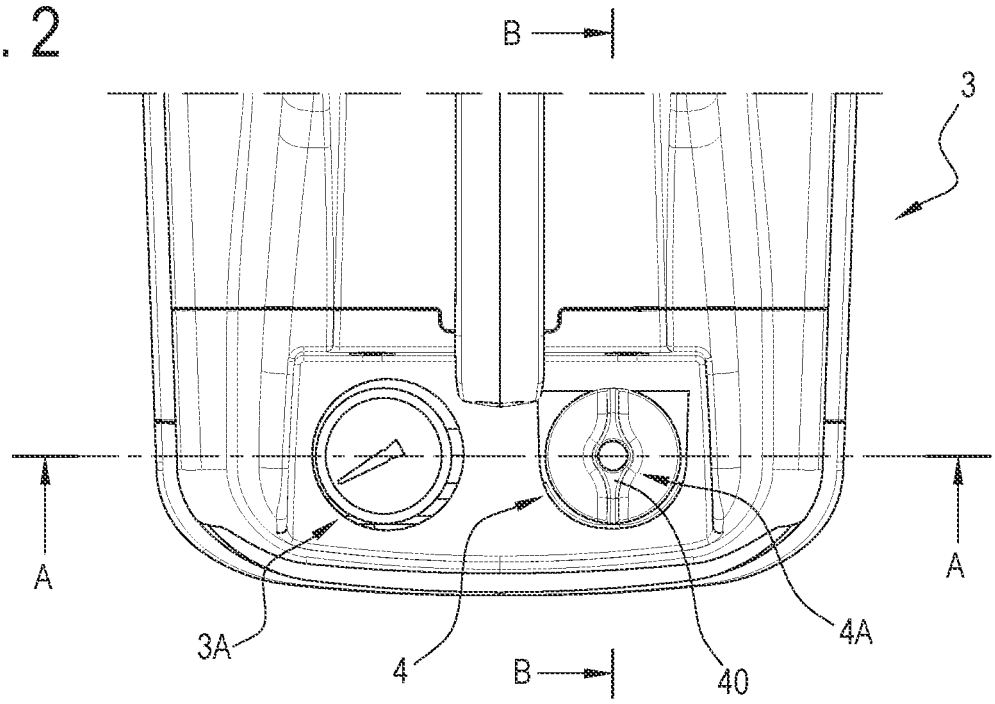
FIG. 2 is a top view of a detail of an air compressor according to this invention illustrated in FIG. 1.

As illustrated in FIG. 1 and in FIG. 2, the switch 4 may be of the type rotatable about an axis of rotation X and may be configured to be in the first operating position and in the second operating position, which is rotated relative to the first position. The rotation may be, for example 180°. The grip element 40 is located at the first surface 4A, which is circular in the example illustrated. The grip element 40 may be formed starting from the surface 4A and may extend away from the housing 3.

Figure 4A:
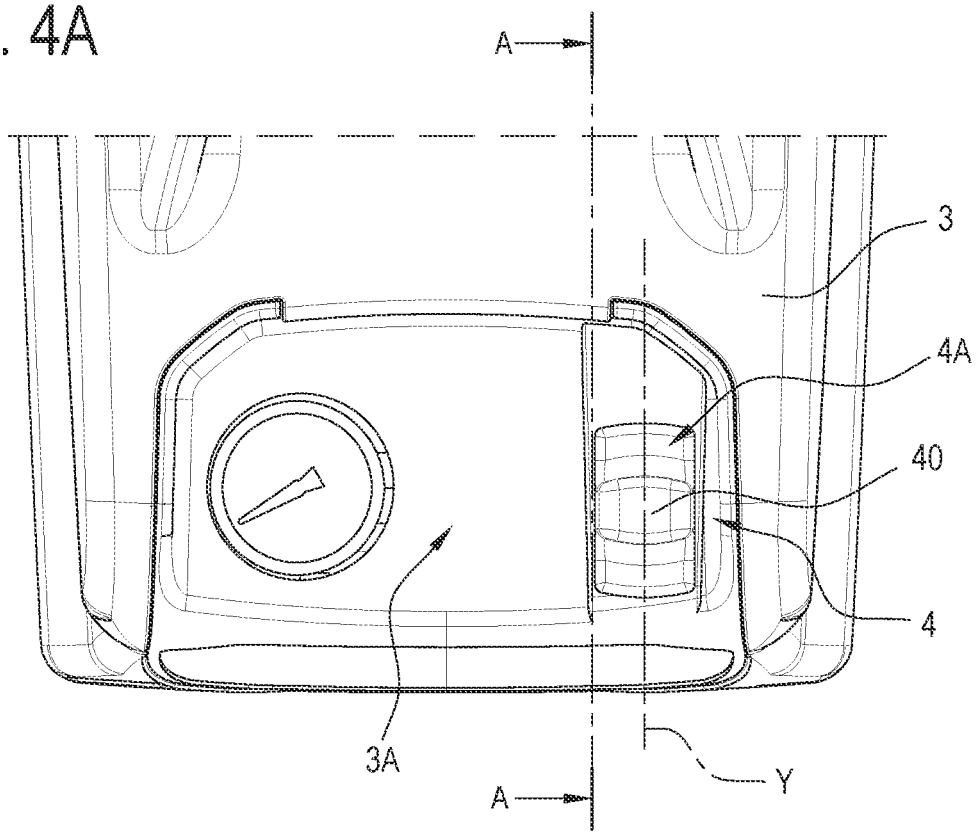
FIGS. 4A and 4B are top views of a detail of the embodiment of an air compressor according to this invention illustrated in FIG. 2.
Figure 4B:
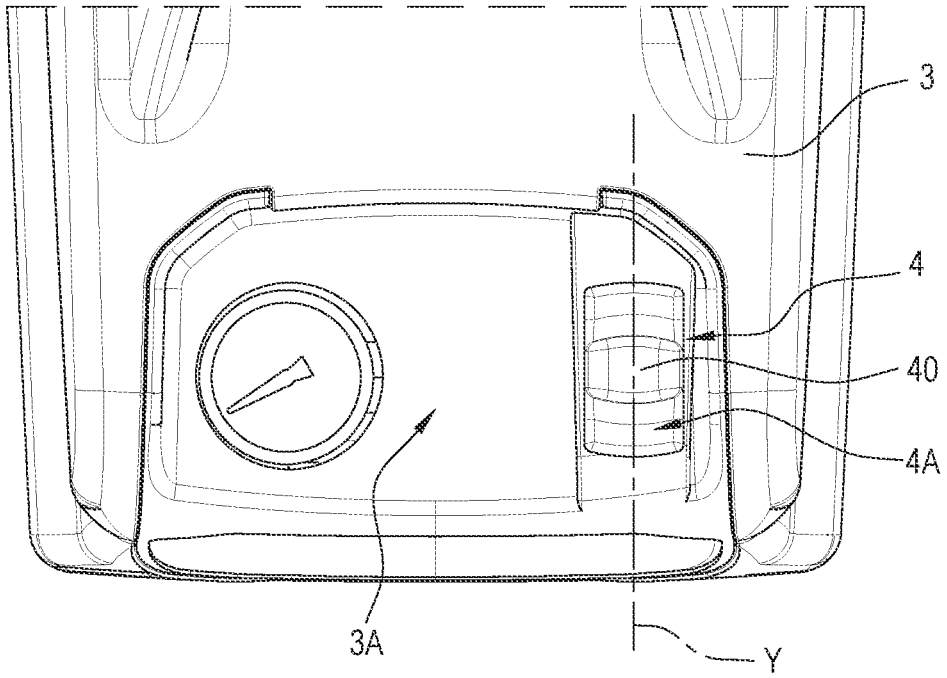

Alternatively, as illustrated in the embodiment of FIG. 3 and in FIGS. 4A and 4B, the switch 4 may comprise a switch translating along a longitudinal line Y. The switch 4 may be configured to switch between the first operating position (illustrated in FIG. 5A) and the second operating position (illustrated in FIG. 5B), translated relative to the first operating position. The grip element 40 of the switch 4 is located at the first surface 4A, which is rectangular in the example illustrated. The grip element 40 may be formed starting from the surface 4A and may extend away from the housing 3.

FIGS. 5A and 5B are side cross-section views of a detail of this invention, wherein the switch 4 is in the second position and in the first position respectively. In particular, in the cross-sections illustrated, the pressure switch 5 and the push-button 50 are visible, which in use are covered by the housing 3.

According to one aspect, the switch 4 may be coupled to the body 5*a* of the pressure switch 5. For example, the switch 4 may comprise a through hole 44 and the body 5*a* of the pressure switch 5 may comprise a receiving seat 52; a fixing element, for example a screw, is configured to be inserted into the through hole 44 and constrained to the seat 52.

Alternatively, the switch 4 may be only constrained to and held in position by the housing 3.

As illustrated in the figures, the axis of rotation X may be parallel to a line along which the push-button 50 moves. The push-button 50 is located a predetermined distance from the axis of rotation X of the switch 4; in other words, the movement of the push-button 50 occurs along an axis parallel to but not coinciding with the axis of rotation X.

The jutting portion 42 of the switch 4 may comprise a cam 42A configured to convert the rotary movement of the switch 4 into a translating movement of the push-button 50 towards or away from the body 5*a* of the pressure switch 5. In this way, by means of a rotation of the switch 4, the push-button 50 passes from the first position to the second position and/or vice versa.

FIGS. 6A and 6B are side cross-section views of details of this invention, illustrated in FIGS. 4A and 4B respectively, wherein the switch 4 is in the first and second position respectively. In particular, in the cross-sections illustrated, the pressure switch 5 and the push-button 50 are visible, which in use are suitably covered by the housing 3.

As illustrated, the switch 4 may be constrained to and held in position by the housing 3. The switch 4 may be composed of parts, one part comprising the jutting portion 42 and the other comprising the grip element 40.

The parts of the switch 4 may for example be held together by a fixing element, not illustrated, for example a screw. Alternatively, the switch 4 may be formed in a single body.

The jutting portion 42 of the switch 4 may comprise a ramp 42B configured to convert the longitudinal translating movement of the switch 4 along the line Y into a translating movement of the push-button 50 along a line perpendicular to the line Y (for example vertical) towards or away from the body 5*a* of the pressure switch 5. In this way, when the switch 4 is made to translate, the push-button 50 passes from the first position to the second position and/or vice versa because the ramp 42B makes contact with the push-button 50 and guides it towards one or the other position. The ramp 42B extends along the longitudinal line Y and/or follows a geometric linear path. In other words, the thickness of the ramp 42B varies along a line parallel to the movement of the push-button 50 of the pressure switch 5 and along the longitudinal line Y.

In the example illustrated, the ramp 42B increases along the longitudinal line Y, in particular from right to left when observing FIGS. 6A and 6B.

The invention claimed is:

1. An air compressor, comprising:

at least one pumping unit comprising at least one cylinder and one piston movable, with reciprocating motion, inside the cylinder, an electric motor configured to drive the at least one pumping unit, a pressure switch, comprising a push-button for activating and deactivating the pressure-switch, movable along a first axis between a first position and a second position, a housing, configured to cover at least said at least one pumping unit, said electric motor and said pressure switch, and a switch, coupled to the housing and movable between a first operating position and a second operating position, said switch being configured to move said activating push-button, such that, when the switch is in the first operating position, the push-button is in the first position and, when the switch is in the second operating position, the push-button has been moved from the first position to the second position, wherein said switch rotates about an axis of rotation to move between the first operating position and the second operating position, wherein the second operating position is rotated relative to the first operating position, wherein the axis of rotation of the switch is parallel to and does not coincide with the first axis along which the movement of the push-button occurs.

2. The air compressor according to claim 1, wherein said switch comprises a grip element;

wherein said grip element projects outside the housing.

3. The air compressor according to claim 1, wherein said switch comprises a jutting portion configured to guide a movement of said push-button and to move the push-button at least one chosen from away from and towards a body of the pressure switch;

wherein the jutting portion is configured to implement at least one switching of the position of the push-button between said first position and second position.

4. The air compressor according to claim 3, wherein said jutting portion projects inside the housing, towards the pressure switch.

5. The air compressor according to claim 1, wherein the second operating position is rotated through 180° relative to the first operating position.

6. The air compressor according to claim 1, wherein said switch comprises a jutting portion configured to guide a movement of said push-button and to move the push-button at least one chosen from away from and towards a body of the pressure switch, the jutting portion comprising a cam.

7. The air compressor according to claim 1, and further comprising an end of stroke element, configured to guide a movement of the switch.

8. The air compressor according to claim 7, and further comprising:

wherein the end of stroke element is located at a first surface of the housing on which said switch is positioned:

wherein the end of stroke element is covered by the switch;

wherein the end of stroke element consists of a rise in the first surface of the housing.

9. The air compressor according to claim 8, wherein the end of stroke element consists of a step-shaped rise.

10. The air compressor according to claim 7, wherein the end of stroke element is configured to prevent a movement of the switch beyond the first operating position and the second operating position.

11. The air compressor according to claim 1, and further comprising a locking element, configured to engage with the switch when the switch is in the first operating position;

wherein the locking element is located at a first surface of the housing on which said switch is positioned;

wherein the locking element is covered by the switch when the switch is in the first operating position;

wherein the locking element prevents the switch from autonomously shifting from the first operating position.

12. The air compressor according to claim 11, wherein the locking element consists of a rise in the first surface of the housing.

13. The air compressor according to claim 12, wherein the locking element consists of a tooth-shaped rise.

14. The air compressor according to claim 1, wherein said switch is only constrained to the housing.

15. The air compressor according to claim 1, wherein said switch is constrained to a body of the pressure switch.

16. An air compressor, comprising:

a pumping unit, a motor configured to drive the pumping unit, a pressure switch, comprising a push-button for activating and deactivating the pressure-switch, movable along a first axis between a first position and a second position, a housing, configured to cover at least a portion of the pumping unit, the motor and the pressure switch, and a switch, coupled to the housing and movable between a first operating position and a second operating position, said switch being configured to move said push-button, such that, when the switch is in the first operating position, the push-button is in the first position and, when the switch is in the second operating position, the push-button has been moved from the first position to the second position, wherein said switch rotates about an axis of rotation to move between the first operating position and the second operating position, wherein the second operating position is rotated relative to the first operating position, wherein the axis of rotation of the switch is parallel to and does not coincide with the first axis along which the movement of the push-button occurs.

* * * * *